US005469682A

United States Patent [19]

Knight

[11] Patent Number: 5,469,682

[45] Date of Patent: Nov. 28, 1995

[54] SOLID END CAP/CORNER UNIT FOR WALL PROTECTION SYSTEM

[75] Inventor: Thomas G. Knight, Muncy, Pa.

[73] Assignee: RJF International, Fairlawn, Ohio

[21] Appl. No.: 309,965

[22] Filed: Sep. 20, 1994

Related U.S. Application Data

[63] Continuation of Ser. No. 152,247, Nov. 12, 1993, abandoned, which is a continuation of Ser. No. 893,985, Jun. 5, 1992, abandoned.

[51] Int. Cl.[6] ..... E04F 19/02

[52] U.S. Cl. ..... 52/718.01; 52/287.1; 52/288.1; 52/716.1; 52/716.4; 52/717.03; 52/717.05; 52/718.02; 52/718.04; 256/59; 256/66; 256/DIG. 6

[58] Field of Search ..... 52/287.1, 288.1, 52/716.1, 716.4, 718.01, 718.02, 717.03, 717.05, 718.04; 256/59, 66, DIG. 6; 248/345.1

[56] References Cited

U.S. PATENT DOCUMENTS

| | | | |
|---|---|---|---|
| 3,825,229 | 7/1974 | Bartlett et al. | 256/59 |
| 3,861,110 | 1/1975 | Bartlett . | |
| 4,053,140 | 10/1977 | Clemens et al. | 256/66 |
| 4,193,585 | 3/1980 | Eandi | 256/65 |
| 4,196,552 | 4/1980 | Bartlett | 248/345.1 X |
| 4,200,261 | 4/1980 | Bartlett | 52/718.1 |
| 4,289,303 | 9/1981 | Hamm | 256/69 |
| 4,646,490 | 3/1987 | Naka et al. | 256/59 |
| 4,696,136 | 9/1987 | Grewe | 52/287 |
| 5,190,267 | 3/1993 | Schmitt et al. | 256/59 |
| 5,193,786 | 3/1993 | Guenther | 256/59 X |
| 5,273,258 | 12/1993 | Bedics | 52/288.1 |
| 5,288,048 | 2/1994 | Shreiner | 256/59 X |

FOREIGN PATENT DOCUMENTS

| | | | |
|---|---|---|---|
| 6417738 | 8/1990 | Japan | 256/59 |
| 3233067 | 10/1991 | Japan | 256/59 |
| 3233068 | 10/1991 | Japan | 256/59 |
| 3233066 | 10/1991 | Japan | 256/59 |

OTHER PUBLICATIONS

Advertising for The Boston Bumper Line pp. 3 and 6.

Advertising for Acrovyn Ergonomic Stye Handrails, pp. 10 and 11.

Advertising for Balco, Inc. Handrails/Bumper Rails, pp. 6 and 8.

Advertising for Kason, Inc. Copper Rails, Crash Rail System, Cabinet Bumper System Bumper Handrail System (2 Sheets).

Advertising for American Floor Products Co, Inc. Powhaton and Aztec Wallguards p. 65.

Advertising for Decrovin Crash Rails/Handrail Systems, pp. 4 and 8.

*Primary Examiner*—Carl D. Friedman
*Assistant Examiner*—Christopher Todd Kent
*Attorney, Agent, or Firm*—Calfee, Halter & Griswold

[57] ABSTRACT

An end cap/corner unit for a wall protection system comprising a substantially solid, impact absorbing, deformable member curved along its length. The end cap/corner unit is anchored to one or two other segments of the wall protection system. It is anchored by an anchoring system which may consist of an insert embedded at the end faces of the end cap/corner unit with a connecting pin extending therethrough. The end cap/corner unit can serve dual purposes, functioning as either an end cap unit or a corner unit.

21 Claims, 5 Drawing Sheets

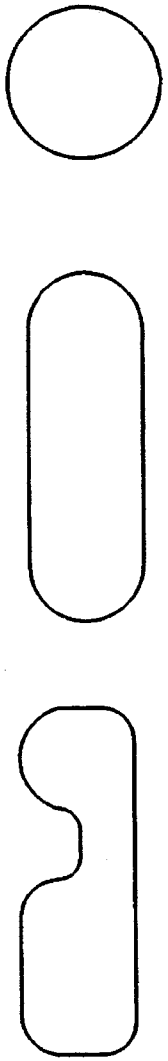
FIG. 5A
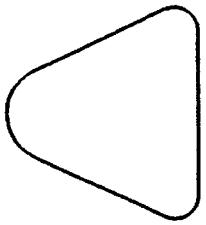
FIG. 5D
FIG. 5B
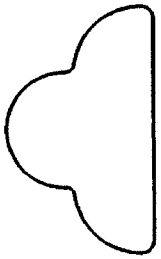
FIG. 5E
FIG. 5C
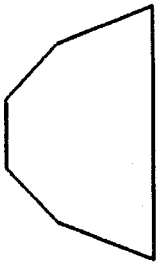
FIG. 5F
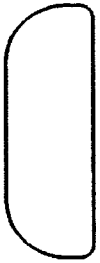
FIG. 5I
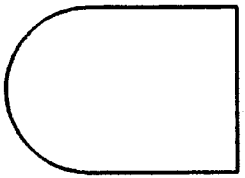
FIG. 5G
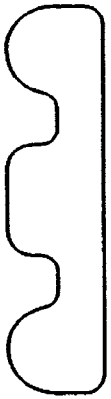
FIG. 5J
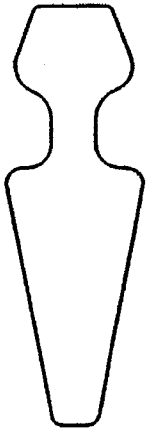
FIG. 5H

SOLID END CAP/CORNER UNIT FOR WALL PROTECTION SYSTEM

This is a continuation of applications Ser. No. 08/152,247 filed on Nov. 12, 1993, now abandoned, which, in turn, is a continuation of application Ser. No. 07/893,985 filed on Jun. 5, 1992, now abandoned.

FIELD OF THE INVENTION

This invention relates to wall protection systems, particularly to the corner or end cap.

BACKGROUND OF THE INVENTION

Wall protection systems have long been found in hospitals and nursing homes. They also appear in many other locations, such as elevators, office buildings, etc. In addition to protecting walls from potentially damaging impacts and collisions, they can provide mobility assistance to persons needing additional support while walking, particularly in the form of stairway railings and corridor handrails.

The main purpose of such systems, however, is to provide a resilient wall protection system that absorbs the impact of moving objects, for example push carts, dollies, hospital gurneys, food carts, mail carts, etc.

A wall protection system can generally be described as consisting of three components—a main segment (typically linear, as are most walls, but can be curved); a corner segment which connects two main segments (typically 90°, but can vary as appropriate to connect the two main segments); and an end cap which fits over the open end of a main segment to close or finish the end.

The main segment can be constructed in a variety of ways, but typically consists of several separate pieces fitted together. A frame (possibly constructed of aluminum, hard plastic or other suitable material) is secured to a wall by a number of wall mounting brackets which are spaced every few feet down the length of the frame. A cover, which may be impact absorbing, is then fitted over the frame, forming the main segment.

End cap and corner segments of present wall protection systems are separate components which are typically hollow. They may be constructed of molded plastic or other impact resistant material.

U.S. Pat. No. 4,200,261 issued Apr. 29, 1980, shows a substantially hollow corner piece fitted between two intersecting sections of the wall protection system. U.S. Pat. No. 3,861,110 issued Jan. 21, 1975 shows an end cap including an internal mounting portion and an external portion. The end cap is fitted into a bumper member so that the bumper member is free to continue to deflect and deform upon impact, keeping the end cap retained in place. The end cap is used to close the internal space defined by the bumper member as an attractive termination of the bumper member. U.S. Pat. No. 3,825,229 issued Jul. 23, 1974 also describes end caps for covering the hollow portion of the longitudinal extensions of a wall protection system.

The end cap and corner segments are two of the more susceptible and frequent contact points for the many abusive impacts which are absorbed by wall protection systems. Impacts to the corners and end caps can produce scuffing, stress whitening and complete fracture of the end cap or corner.

SUMMARY OF THE INVENTION

There is provided in accordance with the present invention, an end cap/corner unit of a wall protection system constructed of a substantially solid, impact absorbing deformable member, curved along its length and having two end faces. The end cap/corner unit has at least first anchoring means for attaching at least one of its end faces to another component of the wall protection system The end cap/corner unit can serve dual purposes, functioning as either an end cap unit or a corner unit.

Upon impact, the substantially solid end cap/corner deflects and absorbs the majority of the impact energy with the remaining impact energy disbursed through the connection to the main segment(s) of the wall protection system.

BRIEF DESCRIPTION OF THE FIGURES

FIGS. 5A–5J show examples of various cross sections to which exemplary end cap/corner units of the present invention can be formed.

DETAILED DESCRIPTION OF THE INVENTION

Figure 1:
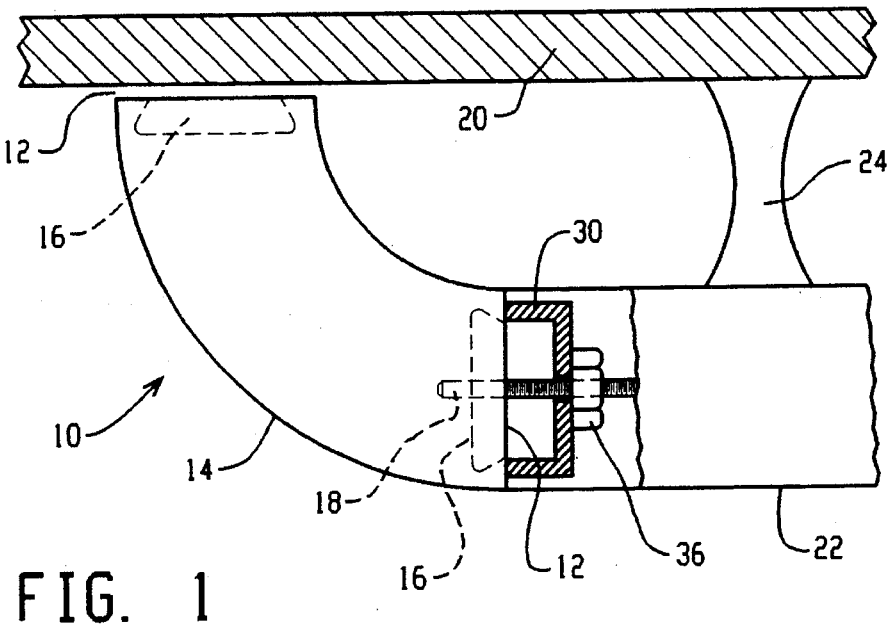
FIG. 1 is a top view, partially exposed of an exemplary end cap/corner unit of the present invention, applied as an end cap.
Figure 2:
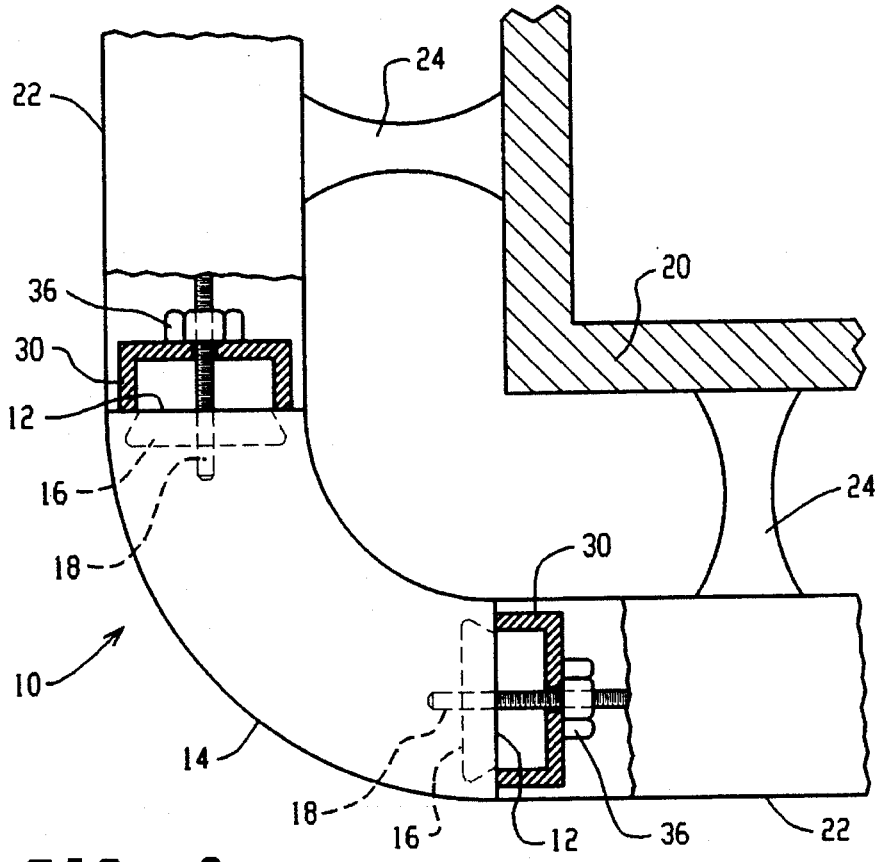
FIG. 2 is a top view, partially exposed of an exemplary end cap/corner unit of the present invention, applied as a corner.
Figure 3:
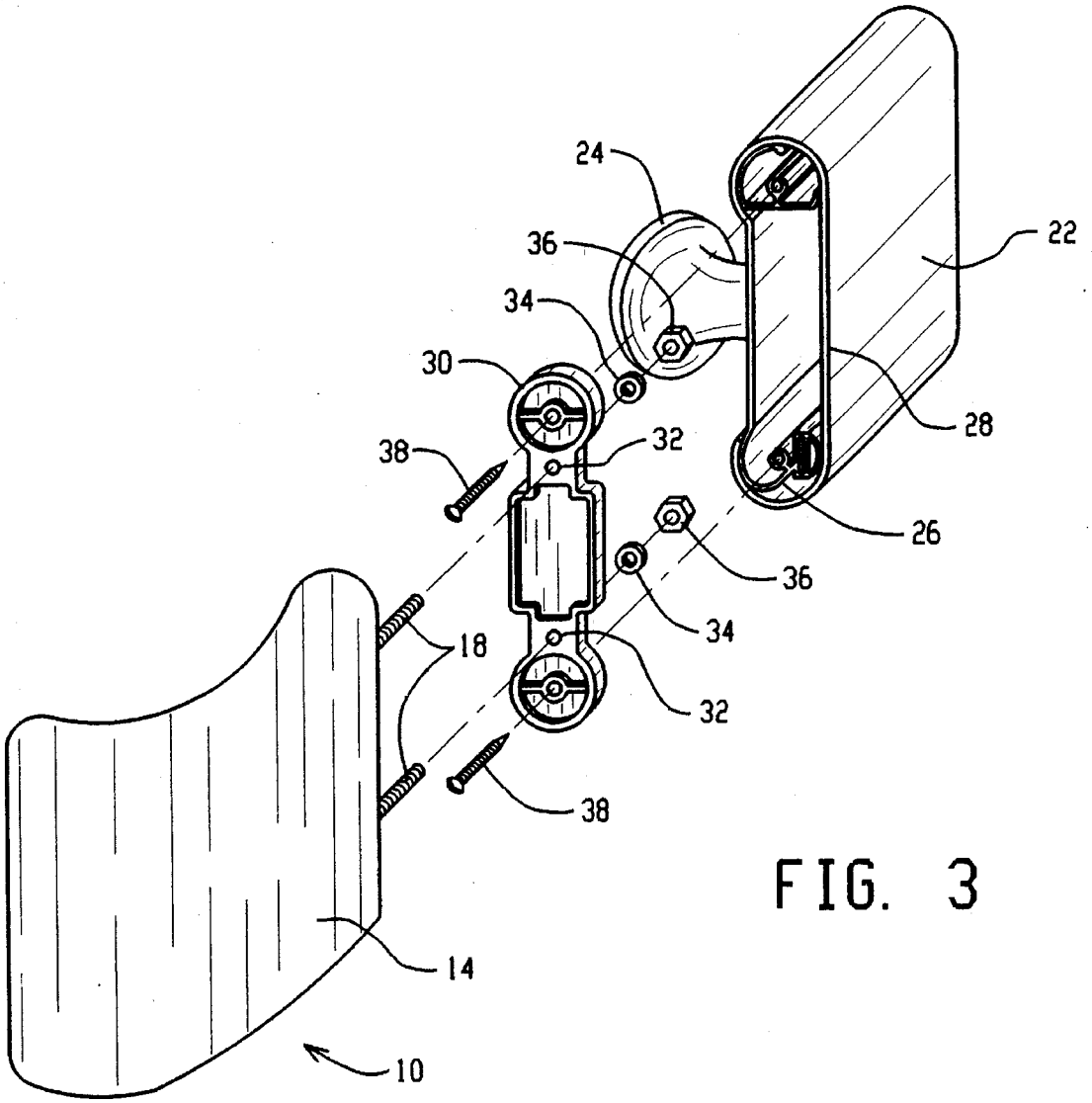
FIG. 3 is a exploded perspective view of an exemplary end cap/corner unit and main segment of a wall protection system of the present invention.

Referring generally to FIGS. 1, 2 and 3, there is shown an end cap/corner unit 10 of the present invention. End cap/corner unit 10 is a component of a wall protection system which connects to other components, such as the main segment(s) which typically make up the major portion of a wall protection system. An end cap unit is connected to a main segment at only one of its ends. A corner unit connects to two main segments, one attached to each end of the corner unit. The present invention can serve the dual purpose of serving as an end cap unit or a corner unit. Accordingly, the description pertaining to a corner equally applies to that of an end cap and vice versa, so the universal designation end cap/corner unit 10 is used throughout the specification.

There is shown in FIG. 1 end cap/corner unit 10 anchored to a main segment 22 of a wall protection system. Main segment 22, as well as end cap/corner unit 10 of the present invention, can serve the dual purposes of a wall protection system and a handrail. Thus, all references to a wall protection system apply equally to a handrail.

The main segment of a wall protection system may generally include coextensive pieces of trim, aluminum frame 26 and an impact-absorbing cushion 28 anchored by a wall mounting bracket 24. Main segment 22 is securely anchored to a wall 20. Wall 20 can be formed of any material used to form a wall, such as plaster, plaster board, wood, masonry, steel, etc. Those skilled in the art will understand the types of wall mounts necessary to secure the main segment to a particular wall material.

End cap/corner unit 10 consists of a resilient substantially solid, impact-absorbing and deformable main body member 14, curved along its length, which will retain its shape following an impact. Example materials, which can form body 14 of end cap/corner unit 10, are polyurethane and other thermoset or thermoplastic materials. Body 14 of end cap/corner unit 10 can be formed using an injection molding process or other process for working thermoplastic or thermoset materials, such as polyurethane.

End cap/corner unit 10 also includes an anchoring system comprising at least one insert 16 (such as an insertion plate) and connection pin 18. In its role as an end cap, as shown in FIG. 1, end cap/corner unit 10 is only connected at one of its two end faces 12. Because of this, only one end face 12 is required to be fitted for anchoring to a main segment. In its role as a corner, as shown in FIG. 2, however, end cap/corner unit 10 is connected to one main segment at each of its two end faces 12 and must have both of its end faces 12 fitted for anchoring. Because end cap/corner unit 10 can function both as an end cap or as a corner, the embodiments shown in FIGS. 1 and 2 show both end faces 12 fitted with an insert 16. As shown in FIG. 1, only one of the end faces 12 is fitted with a connecting pin 18, because end cap/corner unit 10 is shown as an end cap. It is possible to attach the unconnected end face 12 of end cap/corner unit 10 to a wall 20, for additional support. In such an embodiment, wall 20 would receive a mating portion and appropriate accompanying anchoring hardware.

Inserts 16 may be premolded within or attached to end faces 12 of body 14. In FIGS. 1 and 2, insert 16 is embedded within body 14. Insert 16 may be a plate made of a material such as Nylon 6/6 or other rigid material. In the embodiment shown in FIGS. 1 and 2, connecting pins 18 extend through insert 16 and are partially embedded within body 14. Although only one connecting pin 18 is shown, more than one connecting pin may be used. Similarly, although only one insert 16 is shown at an end face 12, an insert 16 may be divided into two or more separate sections, each section having a connecting pin 18 extending therethrough, if desired.

FIG. 3 shows an exploded view of end cap/corner unit 10 with a mating portion 30 attached via attachment screws 38 to a main segment 22. It can be seen that connecting pins 18 pass through holes 32 of mating portion 30 and each is secured by a washer 34 and a nut 36. This achieves a secure mounting of end cap/corner unit 10 to main segment 22. It is within the scope of the invention that the connecting pins 18 and corresponding nuts 36 can be interchanged so that nuts 36 are attached to insert 16, embedded within body 14 to receive connecting pins 18 through mating piece 30.

Figure 4A:
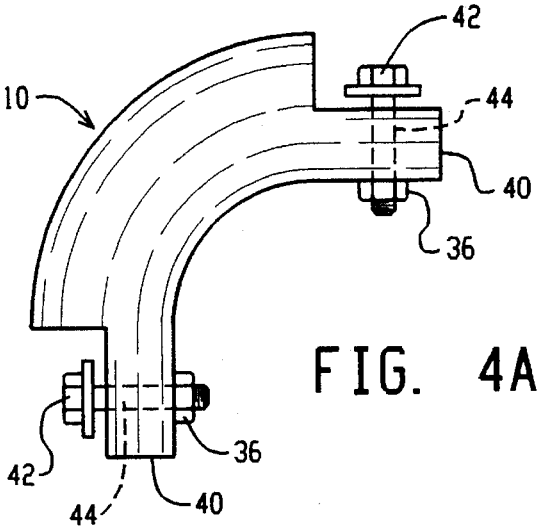
FIGS. 4A–4E show exemplary anchoring systems for end cap/corner units of the present invention.

There is shown in FIGS. 4A through 4E additional embodiments of anchoring systems for anchoring body 14 to main segment(s). In FIG. 4A, a fan flange 40 is shown with a bolt 42 passing through a guide hole 44 in fan flange 40 and secured with a nut 36. A corresponding mating portion of the main segment would be configured to mate with fan flange 40 to achieve a secure fit. This corresponding mating portion would also have a corresponding guide hole through which bolt 40 would also pass through, in anchoring body 14 to a main segment.

Fan flange 40 can be made of the same material as body 14. Fan flange 40 may also be made of another material which is then attached to body 14 by glue (or other adhesive) or by some other attachment means, as would be understood by those skilled in the art.

Figure 4D:
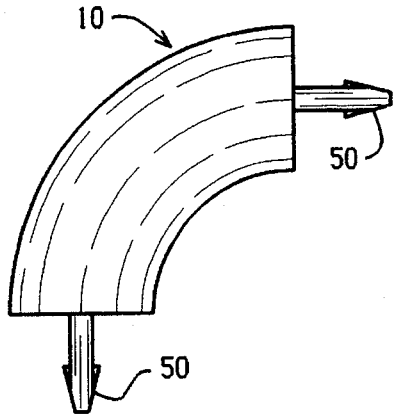
Figure 4B:
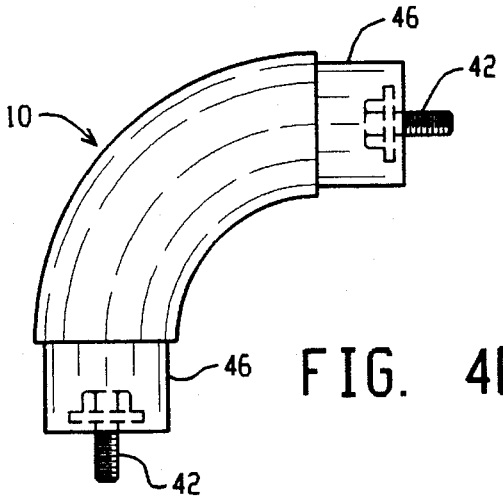

FIG. 4B shows an end cap/corner unit generally similar to that shown in FIGS. 1, 2 and 3, with connector plate system with a connector plate 46 having a bolt 42 premolded within connector plate 46. Connector plate 46 would be received into a corresponding mating portion, such as a sleeve, of the main segment to which it is being anchored. An insert, similar to insert 16, may also be used in fitting bolt 42 or alternatively, a connecting pin 30 (not shown) into connector plate 46. Connector plate 46 may be molded of the same material and within the same mold as body 14. As in the embodiment shown in FIG. 4A, connector plate 46 may also be formed of a material different than body 14 and fastened to body 14 by adhesive or other fastening means.

Figure 4E:
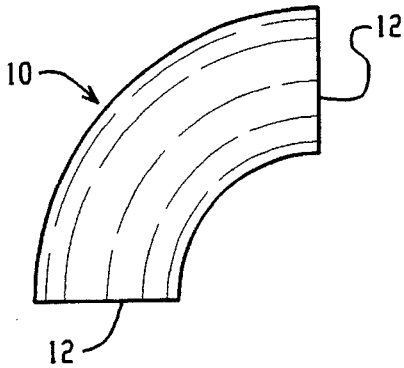
Figure 4C:
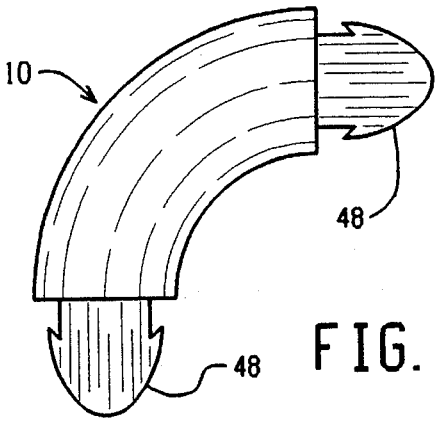

There is shown in FIG. 4C a wedging system comprising a wedge member 48 which may be formed of the same material as body 48. If molded, wedge member 48 may also be formed in the same mold. Wedge member 48 is designed to mate with a mating portion (not shown) in or attached to the main segment and designed to receive the wedge member. A mating portion would consist of an opening through which wedge member 48 can be inserted. The flared end of wedge member 48 would prevent removal from the mating portion, once inserted. As in the previous embodiments, wedge member 48 may also be formed of a material different than body 14.

There is shown in FIG. 4D a body 14 which has a glue or an adhesive applied to its end faces 12. Body 14 with the glue or adhesive can then be fitted to a main segment 22, having a mating portion with a surface, cable of adhesion by glue or other adhesive. Instead of an adhesive, a weld can also be applied.

There is shown in FIG. 4E a pin connection system which uses wedge connecting pins 50. Wedge connecting pins 50 are designed to be inserted into a corresponding mating portion in a main segment 22. Wedge connecting pins 50 may be a hanger-type screw or spring-action anchor (such as WEDGET™). Like the embodiment shown in FIG. 4C, the hanger or spring loaded end of wedge connecting pins 50 would prevent removal from the mating portion, once inserted.

There is shown in FIG. 5 several exemplary cross sections of end cap/corner unit 10, constructed in accordance with the present invention. A cross section could be selected for example to complement the existing cross section of a particular main segment 22.

FIG. 5B shows the cross section of end cap/corner unit 10 shown in FIGS. 1–4E. A cross section such as FIG. 5A would function very well in a wall protection system which also serves as a hand rail, as it is easy to grip. Cross sections such as FIGS. 5D and 5G may be more useful in locations subject to stronger impacts, as the cross section in these figures extends a greater distance in the direction away from a wall 20. As cross sections of the various components of wall protection systems are not required to be identical (although generally the cross sections of the various components are the same throughout a wall protection system), it is possible to mix various cross sections, possibly to provide better functionality at a specific location. Examples would be changing to a better hand rail cross section at one location and a more padded cross section at another.

Figure 6A:
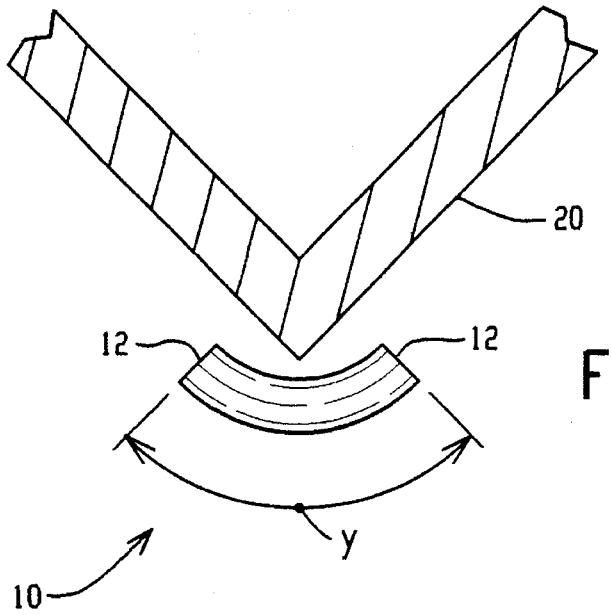
FIGS. 6A–6C are top views showing example angular formations for the exemplary end cap/corner units of the present invention.
Figure 6B:
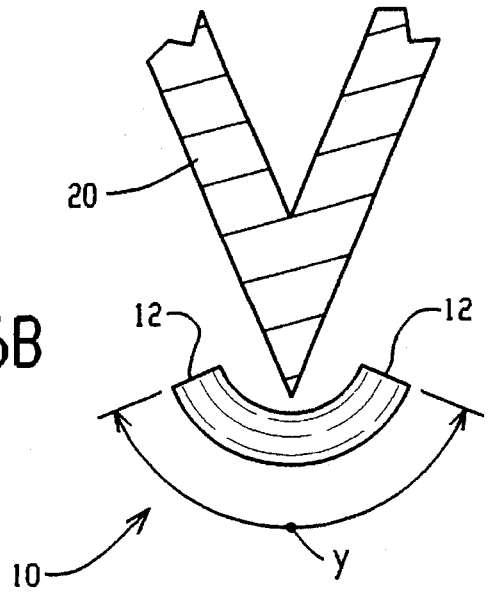
Figure 6C:
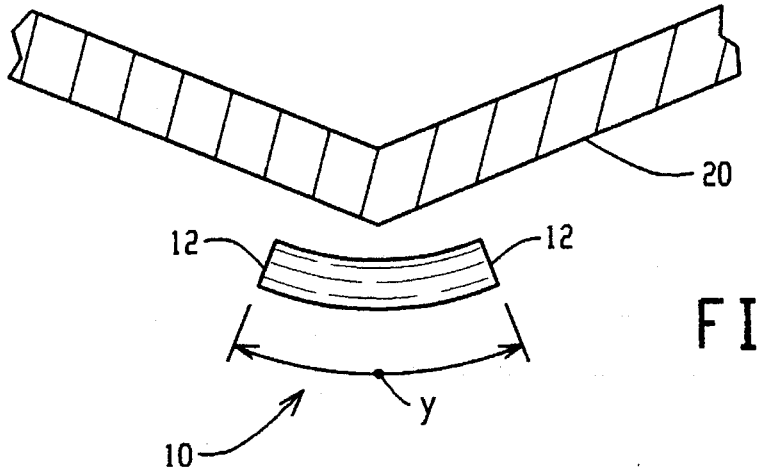

There is shown in FIGS. 6A–6C top views of embodiments of end cap/corner unit 10 in relation to a wall 20, demonstrating the angular diversity of the design. In FIG. 6A, end cap/corner unit 10 is shown with a 90° angle between its two end faces 12. Accordingly, this embodiment of end cap/corner unit 12 is designed to join two main segments at a right angle or serve as an end cap with the non-connected end face 12 flush against a linear wall 20 (see FIG. 1).

The angle Y may be varied from slightly less than 180° to complement a wall 20 that is of a very acute angle (FIG. 6B) to slightly greater than 0° to complement a wall 20 that is of a very obtuse angle (FIG. 6C).

The above described embodiments of the present invention are merely exemplary, and numerous variations and modifications will be readily apparent to those skilled in the art without departing from the spirit and scope of the invention. All such variations and modifications are intended to be included within the scope of the invention.

What is claimed is:

1. An end cap/corner unit for a wall protection system, said wall protection system comprising at least one elongated, hollow main segment formed from a frame, at least one mounting bracket for mounting the frame to a wall and an impact-absorbing cushion on said frame, said main segment also defining at least one main segment end face for attaching the frame thereof to another segment of said wall protection system, said end cap/corner unit comprising a substantially solid body portion formed from a resilient, deformable, impact-absorbing material such that said body portion is capable of absorbing energy on impact with an object but retaining its shape after such impact, said end cap/corner unit defining unit end faces, said body portion being located between said unit end faces, at least one of said unit end faces being adapted for attachment to the frame of said main segment at the main segment end face thereof, the only means in said end cap/corner unit capable of attaching said unit to the other segments in said wall protection system or to said wall being defined in said unit end faces, whereby said end cap/corner unit when secured in place in said wall protection system is mounted only by means of said unit end faces.

2. The end cap/corner unit of claim 1, wherein said body portion consists essentially of said resilient, deformable, impact-absorbing material.

3. The end cap/corner unit of claim 1, wherein the cross-sectional shape of said end cap/corner unit is the same as the cross-sectional shape of said main segment.

4. The end cap/corner unit of claim 1, further comprising anchoring means in at least one of said unit end faces for attaching said end cap/corner unit to the frame of said main segment.

5. The end cap/corner unit of claim 1, wherein said body portion is curved over a substantial portion of its length.

6. The end cap/corner unit of claim 1, wherein said unit has two unit end faces, said unit further comprising anchoring means in each of said unit end faces for attaching said end cap/corner unit to the frame of said main segment, to said wall or to both.

7. The end cap/corner unit of claim 5 wherein at least one of said anchoring means includes an insert imbedded within said body portion.

8. The end cap/corner unit of claim 7 wherein said anchoring means further comprises connecting pins which mate with corresponding connecting holes in said main segment end face.

9. The end cap/corner unit of claim 8 wherein said at least one connecting pin is embedded in said body portion and extends through said insert for attachment to the frame of said main segment.

10. The end cap/corner unit of claim 1 further comprising adhesive attached to at least one of said unit end faces.

11. The end cap/corner unit of claim 1 wherein said substantially solid body portion defines said unit end faces.

12. A wall protection system comprising at least one elongated, hollow main segment formed from a frame, at least one mounting bracket for mounting the frame to a wall and an impact-absorbing cushion on said frame, said main segment also defining at least one main segment end face for attaching the frame thereof to another segment of said wall protection system, an end cap/corner unit comprising a substantially solid body portion formed from a resilient, deformable, impact-absorbing material such that said body portion is capable of absorbing energy on impact with an object but retaining its shape after such impact, said end cap/corner unit defining unit end faces, said body portion being located between said unit end faces, at least one of said unit end faces being attached to the frame of said main segment at the main segment end face thereof, the only means in said end cap/corner unit capable of attaching said unit to the other segments in said wall protection system or to said wall being defined in said unit end faces, whereby said end cap/corner unit when secured in place in said wall protection system is mounted only by means of said unit end faces.

13. The wall protection system of claim 12, wherein said body portion consists essentially of said resilient, deformable, impact-absorbing material.

14. The wall protection system of claim 12, wherein the cross-sectional shape of said end cap/corner unit is the same as the cross-sectional shape of said main segment.

15. The wall protection system of claim 12, further comprising anchoring means in at least one of said unit end faces for attaching said end cap/corner unit to the frame of said main segment.

16. The wall protection system of claim 12, wherein said body portion is curved over a substantial portion of its length.

17. The wall protection system of claim 12, wherein said unit has two unit end faces, said unit further comprising anchoring means in each of said unit end faces for attaching said end cap/corner unit to the frame of said main segment, to said wall or to both.

18. The wall protection system of claim 16 wherein at least one of said anchoring means includes an insert imbedded within said body portion.

19. The wall protection system of claim 18 wherein said anchoring means further comprises connecting pins which mate with corresponding connecting holes in said main segment end face.

20. The wall protection system of claim 19 wherein said at least one connecting pin is embedded in said body portion and extends through said insert for attachment to the frame of said main segment.

21. The wall protection system of claim 12 further comprising adhesive attached to at least one of said unit end faces.

* * * * *